US005793342A

United States Patent [19]

Rhoads

[11] Patent Number: 5,793,342

[45] Date of Patent: Aug. 11, 1998

[54] RESONANT MODE ACTIVE MATRIX TFEL DISPLAY EXCITATION DRIVER WITH SINUSOIDAL LOW POWER ILLUMINATION INPUT

[75] Inventor: Monte Rhoads, Hillsboro, Oreg.

[73] Assignee: Planar Systems, Inc., Beaverton, Oreg.

[21] Appl. No.: 539,311

[22] Filed: Oct. 3, 1995

[51] Int. Cl.[6] ..... G09G 3/30

[52] U.S. Cl. ..... 345/76; 345/211

[58] Field of Search ..... 345/76–77, 212, 345/211; 315/169.3, 169.1; 363/95, 97

[56] References Cited

U.S. PATENT DOCUMENTS

| | | | |
|---|---|---|---|
| 4,574,342 | 3/1986 | Runyan | 363/97 |
| 4,633,141 | 12/1986 | Weber | 345/211 |
| 4,733,228 | 3/1988 | Flegal | 345/76 |
| 5,093,654 | 3/1992 | Swift | 345/76 |
| 5,302,966 | 4/1994 | Stewart | 345/76 |
| 5,517,089 | 5/1996 | Ravid | 315/169.3 |

OTHER PUBLICATIONS 32.2: Charge Modulation Gray–Scale Method with Profiled Current Pulses for ACTFEL Displays by M.H. Aberg, VTT Technical Research Centre of Finland, Semiconductor Laboratory, Espoo, Finland, SID 93 Digest, pp. 765–768.

"19.5: Electrical Characterization and Modeling of ZnS:Mn ACTFEL Devices with Various Pulse Waveforms" by A.A. Douglas, J.F. Wager, Oregon State University, Corvallis, OR, SID 92 Digest, pp. 356–359.

"16–Level Gray–Scale Driver Architecture and Full–Color Driving for TFT–LCD" by K. Takahara, T. Yamaguchi, M. Oda, H. Yamaguchi, M. Okabe, Fujitsu Limited, Atsugi, Japan, 1991 IEEE, pp. 115–118.

"11.3: High–Resolution Active–Matrix Electroluminescent Display" by R. Khormael, S. Thayer, K. Ping, C. King, Planar Systems, Beaverton, OR; G. Dolny, A. Ipri, F–L. Hsueh, R. Stewart, David Sarnoff Research Center, Princeton, NJ; T. Keyser, G. Becker, D. Kagey, Allied Signal Aerospace Corp., Columbia, MD; and M. Spitzer, Kopin Corp., Taunton, MA; SID 94 Digest, p. 137, 3 pages.

"A 6×6–in 20–lpi Electroluminescent Display Panel" by T.P. Brody, F.C. Luo, Z.P. Szepesi, and D.H. Davies, Westinghouse Research Laboratories, Pittsburgh, PA, IEEE Transactions on Electron Devices, vol. Ed–22, No. 9, Sep. 1975, pp. 739–748.

(Abstract continued on next page.)

*Primary Examiner*—Kee M. Tung
*Assistant Examiner*—Matthew Luu
*Attorney, Agent, or Firm*—Chernoff, Vilhauer, McClung & Stenzel

[57] ABSTRACT

Energizing an active matrix electroluminescent device with a generally sinusoidal illumination waveform causes the electroluminescent layer to emit light. A sinusoidal waveform minimizes the peak currents reducing the likelihood of burnouts and decreases the imposed voltages on the data lines increasing the likelihood that the high voltage transistors will function as intended. Preferably, the sinusoidal waveform is generated by using a single 12 volt power source which reduces the expense, weight and bulk of the electroluminescent device. The 12 volt power source may be used to operate an operational amplifier that receives a small sinusoidal input signal and produces a low voltage generally sinusoidal waveform that is amplified by a step-up transformer for energizing the transparent electrode layer of the device so as to cause the electroluminescent layer to emit light. Furthermore, the use of a generally low voltage operational amplifier permits the routing of a 12 volt power signal from a remote power source, such as a battery, to a head-mounted active matrix electroluminescent device, reducing safety concerns routing of high voltage signals near the body of the user.

14 Claims, 2 Drawing Sheets

OTHER PUBLICATIONS 16.4 TFEL Character Module Using a Multilayer Ceramic Substrate, K. Nunomura, Y. Sano, and K. Utsumi, NEC Corporation, Kanagawa, Japan; S. Sakuma, NEC Kansai, Ltd., Shiga, Japan, SID 87 Digest, pp. 299–302.

ACTA Polytechnica Scandinavica, Electrical Engineering Series No. 74, "An Electroluminescent Display Simulation System and its Application for Developing Grey Scale Driving Methods" by Markku Aberg, Helsinki 1993.

High–Voltage TFT Fabricated in Recrystallized Polycrystalline Silicon by T. Unagami and L. Dogure, IEEE Transactions on Electron Devices, vol. 35, No. 3, Mar. 1988.

19.2 Late–News Paper: The Fabrication of TFEL Displays Driven by a–Si TFTs by T. Suzuki, Y. Uno, J. Sakurai, Y. Sato, S. Kyozuka, N. Hiji, T. Ozawa, Fuji Xerox Co., Lt., Kanagawa, Japan, SID 92 Digest, pp. 344–347.

"MOS–EL Integrated Display Device" by K. Oki, Y. Ohkawa, K. Takahara and S. Miura, Fujitsu Laboratories, Ltd., Kobe, Japan, pp. 245–246, reprinted from SID Dig. 1982, pp. 266–267.

"Thin–Film Transistor Switching of Thin–Film Electroluminescent Display Elements" by L.K. Kun, F.C. Luo, and J. Murphy, Westinghouse Research and Development Center, Pittsburgh, PA, pp. 236–242, reprinted from Proc. SID, vol. 21, 1980, pp. 85–91.

"37.1: A 31–in.–Diagonal Full–Color Surface–Discharge ac Plasma Display Panel" by S. Kanagu, Y. Kanazawa, T. Shinoda, K. Yoshikawa, T. Nanto, Fukitsu Ltd., Akashi City, Japan, SID 92 Digest, 4 pages.

Evaluation of a 64×64 CdSe TFT Addressed ACTFEL Display Demonstrator by J. Vanfleteren, J. Capon, J. De Baets, I. De Rycke, H. De Smet, J. Dourtreloigne, A. Van Calster, P. DeVisschere, Laboratory of Electronics, University of Gent, Belgium; and R. Sallmen, R. Graeffe, Planar International, Espoo, Finland, 1991 IEEE, pp. 134–136.

4.6: High–Performance Column Driver for Gray–Scale TFEL Displays, S.A. Teiner, H.Y. Tsoi, Supertex, Inc., Sunnyvale, CA, SID 88 Digest, pp. 31–34.

RESONANT MODE ACTIVE MATRIX TFEL DISPLAY EXCITATION DRIVER WITH SINUSOIDAL LOW POWER ILLUMINATION INPUT

BACKGROUND OF THE INVENTION

The present invention relates to a generally sinusoidal resonant mode excitation driver circuit for an active matrix electroluminescent display.

Conventional row drivers for passive thin-film electroluminescent displays employ both positive and negative high voltage direct-current power supplies and discrete integrated switching devices. Low voltage logic pulses are applied to the row driver inputs to switch the row drivers outputs between the positive and negative high voltage power supplies. Switching between a pair of power supplies produces positive and negative generally rectangular shaped waveforms, e.g., pulse-type waveform, that are imposed across the electroluminescent phosphor layer of the display. An example of a similar type of drive network is Flegal, U.S. Pat. No. 4,733,228, assigned to the same assignee. The components required to fabricate, or otherwise construct, each of the high voltage power supplies may be expensive, heavy, and bulky. Moderately sized power supplies may be acceptable for desktop sized passive thin-film electroluminescent displays where space is available.

The row drivers for passive thin-film electroluminescent displays are digital devices designed to operate by switching between a pair of opposing polarity direct-current power supplies to produce pulsed generally rectangular waveforms. The rectangular waveform has a fast rise time for positive voltages and a fast fall time for negative voltages.

An active matrix electroluminescent (AMEL) device is constructed of a thin-film electroluminescent stack fabricated on a rearwardly disposed substrate layer, typically made of silicon. A portion of the substrate layer includes a circuit layer to select individual pixels within the electroluminescent stack. Energizing a transparent electrode layer within the electroluminescent stack causes all selected pixels within the device to simultaneously emit light.

Active matrix thin-film electroluminescent devices are frequently used as head-mounted displays, so the bulk and weight associated with two high voltage power supplies located near the head of the user is not acceptable. Further, AMEL devices are frequently portable battery powered devices and the power consumption associated with two high voltage power supplies could require a larger battery. Additionally, it is difficult to accurately control the magnitude of the output signal when switching between two direct-current power supplies, which in turn reduces the ability to generate a high quality gray scale image on the display. Pulse-type waveforms also induce high peak currents that could result in burnouts and degraded pixel controllability within the active matrix thin-film display rendering some portions of the display nonfunctional.

Stewart, U.S. Pat. No. 5,302,966 discloses a circuit element to select an individual pixel of an active matrix electroluminescent display. In the Stewart device, the source of a high voltage transistor is connected to a data line. The drain of the high voltage transistor is connected to an electrode of the electroluminescent layer. Energizing the transparent electrode layer illuminates selected pixels within the display with the data lines functioning as a ground return. Data lines have resistance and therefore, the greater the current carried by the data lines, the greater the voltage drop over the length of the data lines. Pulse type waveforms induce high peak currents which impose significant voltage drops over the length of the data lines. These imposed voltage drops may reach such a high level that the sources of the high voltage transistors will develop a high voltage which may interfere with the gate drive of the high voltage transistors.

What is desirable, therefore, is a driver for an active matrix electroluminescent display that does not require a pair of high voltage power supplies. Elimination of these power supplies reduces the expense, weight, and bulk of the device. Also, the device should minimize the imposed voltage drops on the data lines, reduce burnouts, and provide accurate control over the magnitude of the applied illumination waveform to the transparent electrode layer.

SUMMARY OF THE INVENTION

The present invention overcomes the aforementioned drawbacks of the prior art with a driver circuit and a method of energizing an active matrix electroluminescent device with a generally sinusoidal illumination waveform so as to cause the electroluminescent layer to emit light. A sinusoidal waveform minimizes the peak currents reducing the likelihood of burnouts and decreases the imposed voltages on the data lines thereby avoiding imposing a large voltage on the sources of the high voltage transistors which improves pixel controllability and brightness.

For active matrix electroluminescent devices it is desirable to replace the generally rectangular row waveform with a generally sinusoidal illumination waveform. The sinusoidal waveform minimizes the peak currents thereby reducing the voltage imposed along the data lines, thus resulting in higher likelihood of proper operation of the high voltage transistors. Additionally, the sinusoidal waveform reduces the overall stress on the device resulting in fewer burnouts. The reduction in burnouts also increases the life expectancy of the display and reduces the number of field returns.

However, conventional wisdom is that the electronic circuitry required to produce a sinusoidal 400 volts peak-to-peak waveform with accurate control of the waveform voltage is difficult and expensive with integrated circuit devices, as currently employed with passive thin-film electroluminescent displays. In contrast to traditional wisdom, the present invention includes a driver for a sinusoidal illumination waveform that permits accurate control over the output voltage and is relatively inexpensive.

Preferably, the sinusoidal waveform is generated by using a single 12 volt power source which reduces the expense, weight and bulk of the electroluminescent device. The 12 volt power source is used to power an operational amplifier that receives a low voltage sinusoidal input signal and produces an amplified, generally sinusoidal voltage waveform that is further amplified by a step-up transformer for energizing the transparent electrode layer of the device so as to cause the electroluminescent layer to emit light. This method eliminates the use of a pair of expensive, heavy, and bulky high voltage power supplies typically used for passive thin-film electroluminescent devices.

Furthermore, the use of a generally low voltage operational amplifier permits the routing of a 12 volt power signal from a remote power source, such as a battery, to a head-mounted active matrix electroluminescent device. This reduces safety concerns associated with routing high voltage signals near the body of the user.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
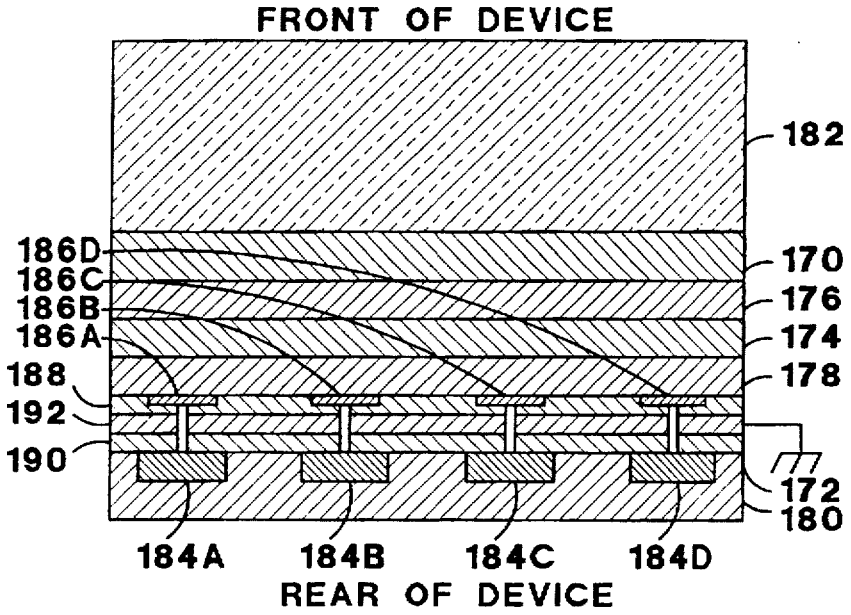
FIG. 1 is a cross-sectional view of an active matrix electroluminescent device.

Referring to FIG. 1, an active matrix electroluminescent (AMEL) device is constructed of a thin-film electroluminescent (laminar) stack comprising a transparent front electrode 170 carrying an illumination signal (waveform), which is typically indium tin oxide deposited on a transparent substrate 182 (glass). A transparent electroluminescent phosphor layer 174 is sandwiched between front and rear dielectric layers 176 and 178, all of which are deposited behind the front electrodes 170. Alternatively, either the front or rear dielectric layer 176 and 178 may be omitted. Pixel electrodes 186*a*, 186*b*, 186*c*, and 186*d* are deposited on the rear dielectric layer 178, typically consisting of a pad of metal or poly-silicon, positioned at each location a pixel is desired within the phosphor layer 174. A first isolation layer 188, second isolation layer 190, and ground plane 192 are deposited on the pixel electrodes 186*a*–186*d* and exposed rear dielectric layer 178. The first and second isolation layers 188 and 190 are preferably constructed out of $SiO_2$ or glass. The first and second isolation layers 188 and 190, and ground plane 192 are preferably constructed with holes, commonly referred to as VIA, for each pixel electrode 186*a*–186*d*, to permit the connection of the pixel electrodes to a circuit layer 172 which is deposited on a substrate layer 180. The substrate layer 180 is typically silicon. The circuit layer 172 permits the individual addressing of each pixel electrode 186*a*–186*d* by its associated circuit element 184*a*–184*d*. As such, an individual pixel within the electroluminescent layer 174 may be selectively illuminated by the circuit layer 172 permitting a sufficient electrical field to be created between the front electrode 170 and the respective pixel electrode 186*a*–186*d*. The circuit layer 172 and circuit elements 184*a*–184*d* therein may be any suitable design, such as those disclosed in U.S. patent application Ser. No. 08/293,144, assigned to the same assignee and incorporated herein by reference.

Figure 2:
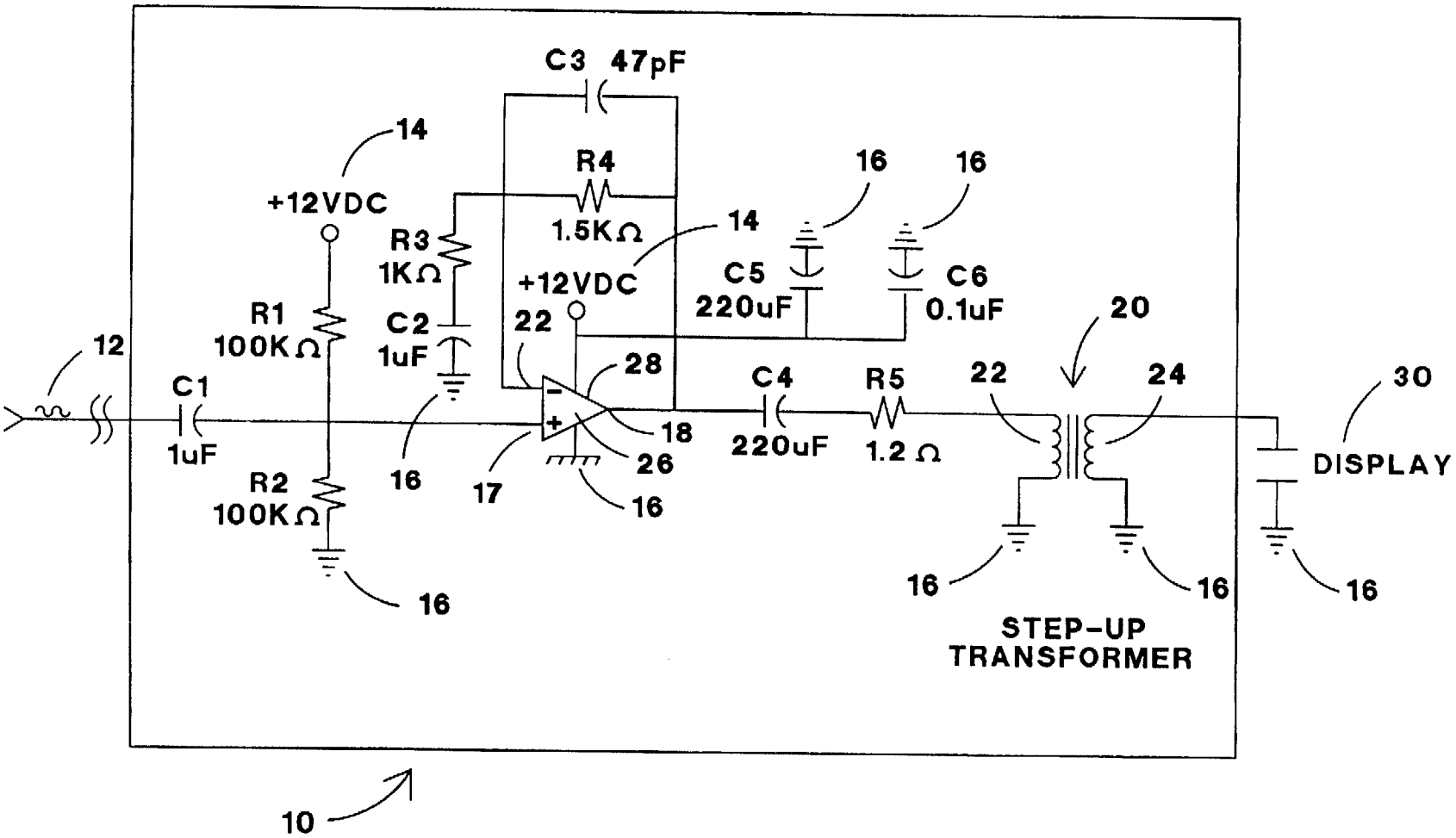
FIG. 2 is an exemplary electrical schematic of a driver circuit constructed in accordance with the present invention.

Referring to FIG. 2, an oscillator (not shown) provides a low voltage generally sinusoidal input signal 12 to the driver circuit 10. Any suitable source may be used that produces a generally or substantially sinusoidal signal. A capacitor C1 electrically decouples any DC components of the input signal 12 from the remainder of the driver circuit 10. Electrically decoupling the direct current component of the input signal 12 allows the driver circuit 10 to independently set the direct-current bias point for amplification of the input signal 12. A pair of series resistors R1 and R2 are connected between a 12 volt direct-current power supply 14 and ground 16 to select the direct-current bias point, which is preferably approximately six volts, for the non-inverting input 17 of an operational amplifier 26. Decoupling the input signal 12 and selecting a direct-current bias point for the input signal 12 to an operational amplifier 26 requires only a single 12 volt power supply and permits the use of a low power, small amplitude, input signal 12 which can be readily generated by a simple oscillator circuit. The operational amplifier could alternatively use dual low voltage power supplies or a higher voltage power supply, if desired.

The six volt direct-current bias point, which is half of the voltage from the power supply 14 applied to the operational amplifier 26, permits the maximum voltage swing from the output 18 of the operational amplifier 26 without clipping. The input signal 12 and signal from the power supply 14 are preferably transmitted from a remote location to the display, such as the user's belt-worn computer, when the display is used as a head-mounted device. The transmission of relatively low voltages from the power supply 14 and input signal 12 minimizes safety concerns with routing high voltage signals near the body of the user when the display is used as a head-mounted device. An example of such a head-mounted system is described in U.S. Patent Application entitled "Substrate Carriers for Electroluminescent Displays," filed Jun. 23, 1995, assigned to the same assignee and incorporated herein by reference.

The output 18 of the operational amplifier 26 is connected to the inverting input 22 of the operational amplifier 26 through a network, including a parallel capacitor C3 and resistor R4 network. The capacitor C3 attenuates high frequency signals to prevent oscillations. The resistor R4 controls a portion of the gain of the output 18 of the operational amplifier 26. Alternatively, resistor R4 could be connected in parallel with a variable resistor (not shown) to permit variable gain control, or otherwise replaced with a variable resistor to permit variable gain control. Increasing and decreasing the resistance of R4 increases and decreases, respectively, the gain of the output 18. Additionally, a resistor R3 is connected between the inverting input 22 of the operational amplifier 26 and a capacitor C2 to provide further gain control. Increasing and decreasing the resistance of R3 decreases and increases, respectively, the gain of the output 18. Resistor R3 may be replaced by a variable resistance. The resistor R3 is capacitively coupled to ground 16 through capacitor C2 to eliminate any direct-current gain which helps prevent clipping of the output 18.

Connected to the power supply input 28 of the operational amplifier 26 is a sufficiently large capacitor C5 to store energy for peak current demands and a bypass capacitor C6 to attenuate high frequency signals to prevent oscillation. The combination of the capacitors C5 and C6 provide decoupling for the power supply 14.

The output 18 of the operational amplifier 26 is capacitively coupled by capacitor C4 to the remainder of the driver circuit 10. The capacitor C4 prevents driving direct-current signals into a low impedance primary 18 of a step-up-transformer 20. This reduces the power required from the output 18 of the operational amplifier 26.

The primary 22 of the step-up-transformer 20 receives a generally sinusoidal signal from the output 18 of the operational amplifier 26. The windings of the primary 22 and secondary 24 are selected to increase the magnitude of the sinusoidal signal to preferably a 400 volt peak-to-peak illumination waveform. When the input signal 12 is first energized the slew rate of the operational amplifier 26 limits the rate of increase of its output 18. However, the rate of increase may be sufficiently high, producing peak currents that result in burnouts and impose a sufficiently large voltage drop on the data lines. The resistor R5 limits the peak current levels produced when initially imposing the input signal 12 at the inverting input 17 of the operational amplifier 26.

The driver circuit 10 provides a 400 volt peak-to-peak generally or substantially sinusoidal waveform. Additionally, this circuit operating with a limited number of relatively inexpensive components. The driver circuit 10 may operate either continuously or in a burst mode to provide the desired illumination waveform with the desired magnitudes by adjusting the gain of the operational amplifier 26. The gain may be adjusted at any appropriate time. Accordingly, only single low voltage power supply, such as a 12 volt power supply, is required which reduces the bulk, size, and expense of the driver circuit.

The secondary 24 of the transformer 20 is generally modeled as an inductor. The display 30 is generally modeled as a capacitive load based upon the weighted average of a typical display pattern (i.e., the average number of illuminated pixels). The frequency of the applied sinusoidal waveform is preferably selected at the resonant frequency of the tank circuit formed by the combined transformer secondary 24 and the display 30 so as to minimize the dissipation of energy. The preferred frequency of the illumination waveform is about 5 KHz. The inductance (L) of the secondary 24 is selected to be $L=1/|4\pi^2CF^2|$.

The combination of the inductance of the secondary 24 and capacitance of the display 30 provide a resonant system at the desired frequency which minimizes the power required to operate the display. Theoretically, after the system is at resonance, there is no reactive power consumption. However, some real power is consumed by the inherent resistance of the electronic components and display. Minimizing the power consumption is important for a battery powered active matrix electroluminescent device.

It is also important to ensure that the rest of the system does not oscillate at resonance. The resistor R5 also moves the primary 22 off resonance so that the remainder of the system does not oscillate.

To determine the proper inductance of the primary 22, the inductance of the secondary 24 is divided by the turns ratio squared. With the turns ratio and the desired magnitude of the illumination waveform, the necessary voltage from the output 18 of the operational amplifier 26 is determined. The gain of the operational amplifier 26 is adjusted to provide the desired magnitude of the illumination waveform.

For monochrome and color displays a gray scale is desirable in order to display video and graphic images with better screen clarity and definition. Many current techniques to achieve a gray scale for thin film electroluminescent displays can be broadly categorized as those calling for modulation of the amount of charge flow through the phosphor layer. Those techniques may be further divided into two subcategories, namely, amplitude modulation and pulse width modulation. A further modulation technique is to employ bursts of pulses of variable time duration applied to the phosphor layer, such as those described in U.S. patent application Ser. No. 08/341,404, assigned to the same assignee and is incorporated herein by reference. To achieve a gray scale using several of the available techniques, the transparent electrode driver requires accurate amplitude control and the ability to provide multiple bursts of pulses.

The driver circuit 10 has the ability to operate in a burst mode. The input signal 12 provides the desired number of sinewave pulses and the output of the transformer 20, in turn, supplies the corresponding illumination signal. The resistor R5 limits the rate of increase of the signal so that current levels are maintained at acceptable levels.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of illuminating an electroluminescent device comprising the steps of:

(a) providing said electroluminescent device for said illuminating with a plurality of layers including at least a transparent electrode layer, a circuit layer, and at least two layers including an electroluminescent layer and a dielectric layer, said at least two layers disposed between said circuit layer and said transparent electrode layer;

(b) receiving a low voltage generally sinusoidal input waveform and in response producing a generally sinusoidal intermediate waveform having a voltage greater than said input waveform;

(c) receiving said intermediate waveform in a primary of a step-up transformer and in response generating a generally sinusoidal illumination waveform having a voltage greater than said intermediate waveform at a secondary of said transformer; and (d) energizing said transparent electrode layer with said illumination waveform so as to cause said electroluminescent layer to emit light.

2. The method of claim 1 further comprising the step of selecting a frequency of said illumination waveform to be near a resonant frequency of a circuit comprising the combination of an inductor formed by said secondary and a capacitor formed by said plurality of layers.

3. The method of claim 2 further comprising the step of controlling an impedance of said primary such that said primary does not resonate with said combination of said secondary and said plurality of layers.

4. The method of claim 2 further comprising the step of receiving said input waveform in an operational amplifier and producing said intermediate waveform from said operational amplifier.

5. The method of claim 4 further comprising the step of adjusting a gain of said operational amplifier.

6. The method of claim 4 further comprising the step of powering said operational amplifier with a power signal in the range of 12 volts.

7. The method of claim 6 further comprising the step of transmitting said power signal from a remote location to said operational amplifier.

8. A driver circuit for providing a generally sinusoidal illumination signal to an active matrix thin-film electroluminescent display comprising:

(a) an amplifier having an input and an output;

(b) said amplifier receiving at said input a low voltage generally sinusoidal input waveform and producing at said output a generally sinusoidal intermediate waveform having a voltage greater than said input waveform; and (c) a step-up transformer having both a primary electrically connected to said output so as to receive said intermediate waveform, and a secondary electrically connected to said display so as to provide said generally sinusoidal illumination signal having a voltage greater than said intermediate waveform.

9. The driver circuit of claim 8 wherein said illumination signal is a generally sinusoidal signal of around 400 volts peak to peak.

10. The driver circuit of claim 8 wherein said amplifier is powered by an approximately 12 volt signal.

11. The driver circuit of claim 8 further comprising a variable resistor electrically connected to said amplifier to adjust the magnitude of said intermediate waveform.

12. The driver circuit of claim 8 wherein a frequency of said illumination signal is selected to be near a resonant frequency of a tank circuit comprising the combination of an inductor formed by said secondary and a capacitor formed by said display.

13. The driver circuit of claim 12 further comprising an electrical device electrically connected to said primary to select a resonant frequency of said primary to be different than said resonant frequency of said tank circuit.

14. The driver circuit of claim 13 wherein said electrical device is a resistor.

* * * * *